United States Patent [19]

Ninet et al.

[11] 4,408,930

[45] Oct. 11, 1983

[54] DEVICE FOR DAMPING IMPACTS BETWEEN A LOAD AND A FLOATING SUPPORT WHEN THE LOAD IS REMOVED

[75] Inventors: Jean-Louis Ninet; Robert Vaillant, both of Nantes, France

[73] Assignee: Societe Anonyme dite Ateliers et Chantiers de Bretagne-ACB, Nantes, France

[21] Appl. No.: 295,453

[22] Filed: Aug. 24, 1981

[30] Foreign Application Priority Data

Dec. 23, 1980 [FR] France ..... 80 27348

[51] Int. Cl.[3] ..... E02B 17/08

[52] U.S. Cl. ..... 405/209; 248/632; 267/141; 405/195; 405/204; 405/205

[58] Field of Search ..... 405/195–199, 405/203–209, 211–213; 267/140, 141, 153; 114/219, 220; 248/632, 634, 678

[56] References Cited

U.S. PATENT DOCUMENTS

| | | | |
|---|---|---|---|
| 2,262,443 | 11/1941 | Anderson | 248/632 X |
| 2,734,739 | 2/1956 | Messina | 267/140 |
| 2,817,212 | 12/1957 | Stubbs . | |
| 2,881,590 | 4/1959 | Zaskey . | |
| 3,376,031 | 2/1968 | Lee . | |
| 3,606,295 | 9/1971 | Appleton | 267/153 X |
| 4,006,505 | 2/1977 | Koster et al. | 267/141 X |
| 4,195,950 | 1/1980 | Goldman | 405/195 |

FOREIGN PATENT DOCUMENTS

| | | | |
|---|---|---|---|
| 1214760 | 4/1960 | France | 405/209 |
| 1463297 | 1/1966 | France . | |
| 2224395 | 10/1974 | France . | |
| 2312603 | 12/1976 | France . | |
| 2383118 | 10/1977 | France . | |
| 7400716 | 7/1975 | Netherlands . | |
| 7801724 | 8/1979 | Netherlands . | |
| 7804479 | 10/1979 | Netherlands . | |
| 2022662 | 12/1979 | United Kingdom | 405/209 |
| 2028404 | 3/1980 | United Kingdom . | |

*Primary Examiner*—Dennis L. Taylor

*Attorney, Agent, or Firm*—Sughrue, Mion, Zinn, Macpeak & Seas

[57] ABSTRACT

A device for damping impacts between a load (1) and a floating support (70) while the load is being removed from said support which includes at least one housing (10) on which the load rests. The device includes means (11, 15, 18) for automatically and irreversibly inserting a damping unit (14) between the load and its bearing point on the floating support as soon as the weight of the load is removed from the bearing point.

2 Claims, 6 Drawing Figures

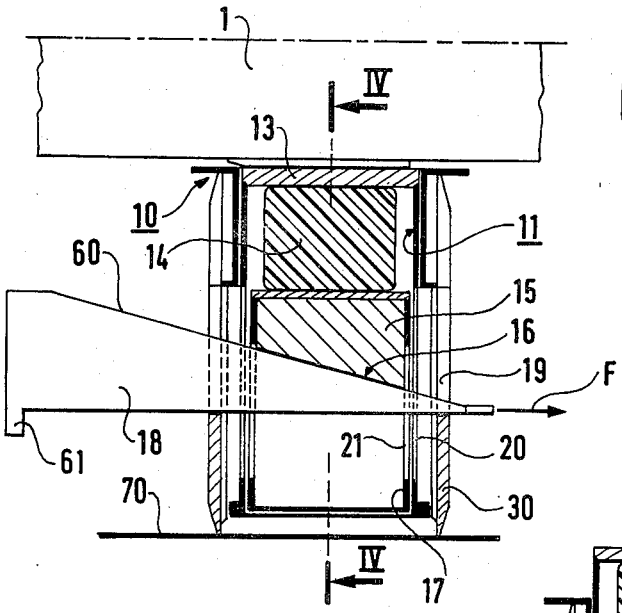
FIG.1
FIG.2
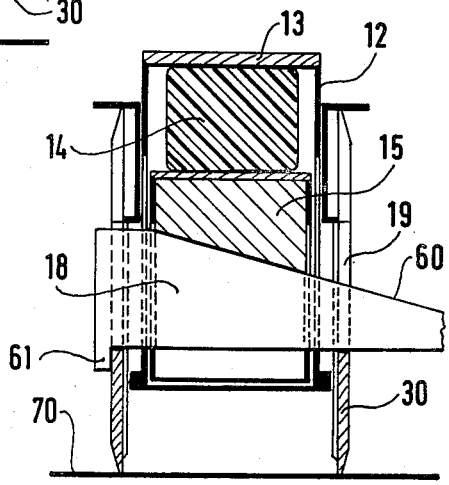
FIG.3
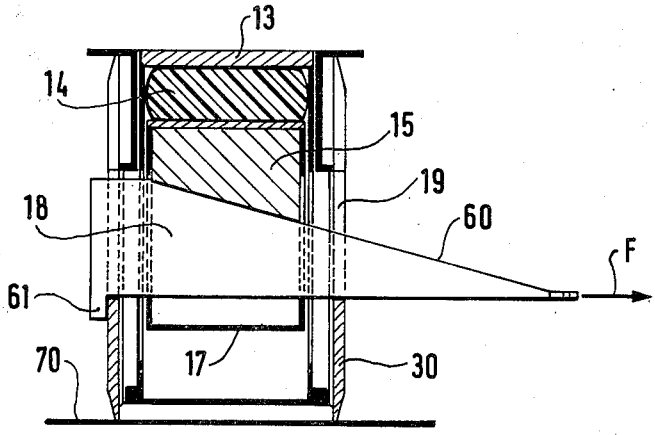

DEVICE FOR DAMPING IMPACTS BETWEEN A LOAD AND A FLOATING SUPPORT WHEN THE LOAD IS REMOVED

The present invention relates to a device for damping impacts between a load and a floating support while the load is being removed from the floating support.

BACKGROUND OF THE INVENTION

When removing a very heavy load (e.g. an off-shore platform) from a floating barge to place it on a non-floating support (e.g. another floating support or a structure standing on the sea bed), there is a critical period when the load is no longer completely supported by the floating support. This period continues until the load and the floating support are completely separated. During the critical period the floating support tends to drop away from the load during troughs in the swell and then to collide with the load when the swell rises to a crest. Therefore, to prevent damage to the equipment (load and floating support) it is necessary to provide damping means between them.

However, during transport, and before the load is transferred there is a contrary requirement for a rigid, non-resilient link between them without any damping means which link is usually an iron-to-iron link. Damping units therefore tend to be brought into use only just before unloading. One known technique consists in lifting the load on the floating support so as to be able to insert damping units between said floating support and the load. However, there are disadvantages to this solution.

Even if unloading takes place immediately after the damping units are in place, there remains a period during which the load is resiliently connected to a floating support and therefore there is a danger of resonance under the effect of the swell. Further, if the lifting operation for inserting the damping units is to avoid the original problem which the damping units are supposed to solve, it is necessary for the lifting equipment to form part of the floating support itself. This requires large hoisting means and extra support points, etc.

SUMMARY OF THE INVENTION

Preferred embodiments of the present invention mitigate these disadvantages. The present invention provides a device for damping impacts between a load and a floating support while the load is being removed from said support which includes at least one housing on which the load rests, wherein the device includes means for automatically and irreversibly inserting a damping unit between the load and its bearing point on the floating support as soon as the weight of the load is removed from the bearing point.

According to a particular embodiment of the present invention, said means include a sleeve with an end plate located near the top and disposed inside said housing and a damping unit located inside said sleeve and held against said end plate by means of a chock whose lower surface is inclined and which co-operates with a wedge which passes through said housing and said sleeve via slots provided in the vertical walls of the housing and of the sleeve, the chock being vertically movable inside the sleeve and said wedge being subjected to a horizontal traction force, the upper surface of the end plate of the sleeve being level with the top of the housing during transport of the load so that it rests on the housing.

BRIEF DESCRIPTION OF THE DRAWINGS

The invention will be better understood from the following description of an embodiment given by way of example with reference to the accompanying drawings in which:

FIGS. 1, 2 and 3 show a device in accordance with the invention in various positions.

DESCRIPTION OF PREFERRED EMBODIMENT

Figure 4:
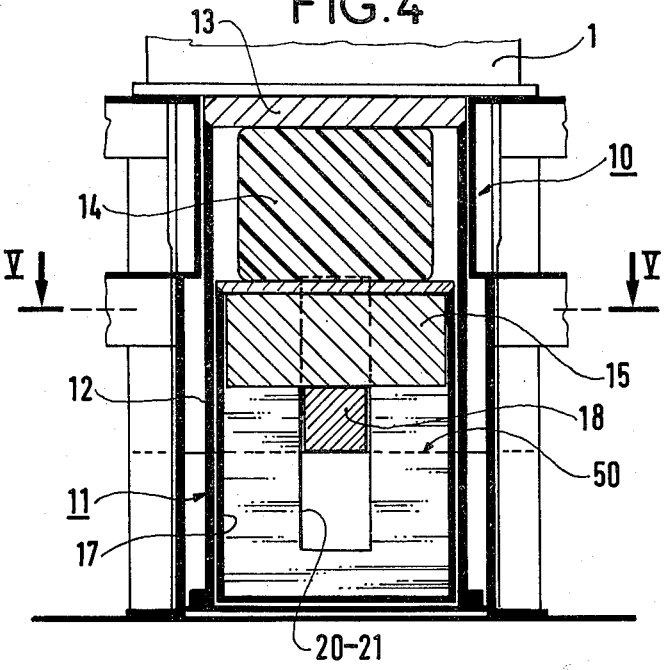
FIG. 4 is an enlarged view of a cross-section along IV—IV of FIG. 1.
Figure 5:
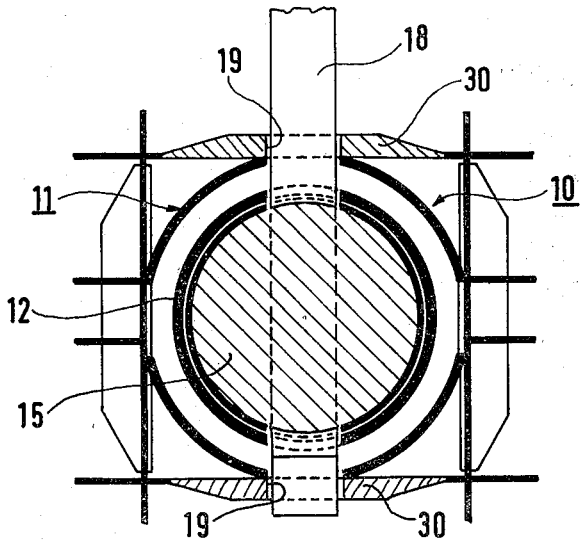
FIG. 5 is a cross-section along V—V of FIG. 4.

As illustrated in FIGS. 1, 4 and 5, a device in accordance with the invention includes a housing 10 integral with a floating support 70 for a load 1.

The housing 10 has two strong solid parts 30 on two of its surfaces. A sleeve 11 with a cylindrical side wall 12 and an end plate 13 at the upper end of the side wall is disposed inside this housing. A shock absorber 14, e.g. an elastomer block, is placed at the end of the sleeve 11. A chock 15 with an inclined lower surface 16 is placed beneath this shock absorber. It is placed at the end of a cylindrical box 17 which is vertically slidable in the sleeve 11, more or less compressing the shock absorber 14.

A wedge 18 with an inclined upper surface 60 co-operates with the chock 15 and passes through the housing 10, the sleeve 11 and the box 17 via slots 19 provided through the solid parts 30 of the housing 10, slots 20 through the sleeve 11, and slots 21 through the box 17. The wedge 18 rests against the ends 50 of the slots 19 provided in the solid parts 30; pulling on the wedge 18 in the direction of arrow F raises the chock 15 and, if no heavy weight is applied to the top of the end plate 13 of the sleeve 11, also raises the damping unit 14 and the sleeves 11, as illustrated in FIG. 2.

Pull in the direction of the arrow F can be exerted by any suitable means: taut nylon, a weight suspended from the edges of the floating support with a guide pulley, etc.

The travel of the wedge 18 is limited by a stop 61.

Operation of the device is as follows: during transport, the wedge 18 is in the position shown in FIG. 1. In this position, the chock 15 and the sleeve 11 are in the lower position, the assembly is retracted into the housing 10 and the load 1 rests on the housing (FIGS. 1 and 4). While the load is being removed, as it moves away from the floating support 70, e.g. in the trough of a wave, the sleeve 1 is relieved of its weight and under the force exerted on the wedge 18 in the direction of the arrow F, the wedge moves and the chock 15 is thereby raised as are the damping unit 14 and the sleeve 11. The position obtained is then that of FIG. 2. When, on the contrary, the floating support 70 rises under the effect of a high wave and the load is not yet sufficiently raised, the weight of the load then compresses the damping unit 14 as shown in FIG. 3.

In these two FIGS. 2 and 3, the load 1 is not shown, but of course, it rests on the device as in FIGS. 1 and 4.

It is now seen that the device makes it possible to automatically insert a damping unit between the load and its floating support only when the load is being removed.

Therefore, there is no instability period as in known devices since the damping unit operates only during the actual removal of the load. Also, no auxiliary load-hoisting devices need be installed on the floating support.

Of course, the angle of the wedge 18 is calculated taking into consideration the friction coefficient and the force F so that the movement is non-reversible whatever the load on the sleeve 11 may be.

Figure 6:
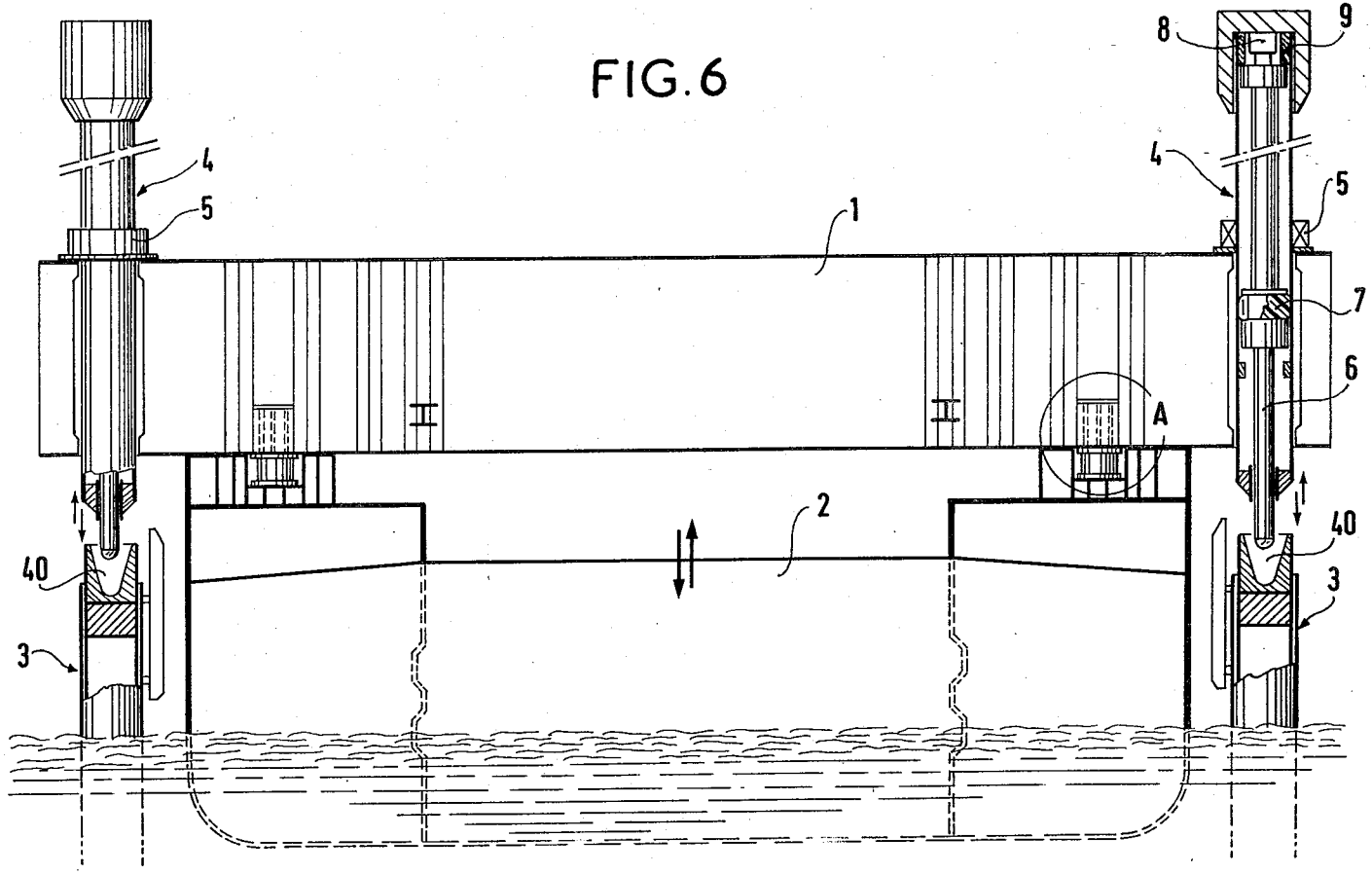
FIG. 6 is a general illustration of a particular application of the invention in the particularly advantageous case of the removal of an offshore platform from its transport barge and of the positioning thereof on a previously installed stationary structure. The portion in circle A of this figure is illustrated in detail in the preceding figures.

FIG. 6 illustrates a particularly advantageous application of an off-shore platform being unloaded from a transport barge and being set on a previously installed stationary structure.

The figure shows a platform 1 supported by a floating barge 2. The platform must be set on a support structure having legs 3 which emlerge and have centring cones 40. The platform 2 is provided with piles 4 which are moved by means of a hoisting system 5. The piles have damping units inside them which damping units have rods 6 which bear against damping units 7 made e.g. of elastomer. A jack 8 associated with removable shims 9 allows the final positioning of the piles 4 against the legs 3 and allows the piles to be welded to the legs while the load of the platform is not yet resting or wholly resting on the tops of the legs but only on the centering cones 40 by means of the rods 6, the damping unit 7 and the jack 8. This device is described in detail in the patent application filed this day, assigned to the same assignees, and entitled "A device for positioning an off-shore platform on its support structure".

The device A in accordance with the present invention described in detail in the preceding figures is placed between the platform 1 and the transport barge 2. Thus, in this application, the platform 1 is lifted off the barge 2 by means of the hoisting system 5 which firstly lowers the pile 4 until the rod 6 comes into contact with the centering cone 4, the effect of the swell being damped by the damping unit 7; simultaneously, the impacts between the barge 2 and the platform 1 due to the crest of a wave and to a trough during which the platform bearing on the legs 3 rises off the barge 2 are damped by the devices A in accordance with the invention and described hereinabove.

What is claimed is:

1. A device for damping impacts between a load and an underlying floatingg support at a load bearing point while the load is being removed from said support, said support including at least one housing extending vertically upwardly therefrom on which the load rests and defining a load bearing point, said device comprising:

a damping component mounted within said housing for movement towards and away from said load, and a wedge operatively engaging said damping component for movement horizontally, and means for subjecting said wedge to a horizontal traction force to automatically and irreversibly insert said damping component between said load and its bearing point on the floating support as soon as the load is removed from said floating support.

2. A device for damping impacts between and a floating support underlying said load while said load is being removed from said support, at least one housing borne by said floating support on which said load rests to define a load bearing point, a sleeve with an overlying end plate disposed inside said housing and located near the top of said housing, a damping unit mounted within said sleeve, a chock within said sleeve for holding said damping unit against said end plate, said chock having a lower surface which is inclined, aligned vertical slots provided within walls of said housing and said sleeve, a wedge passing through said housing and said sleeve via said slots and provided with an inclined surface matching that of said chock and engaging said inclined surface of said chock, said chock being vertically movable inside said sleeve, means for subjecting said wedge to a horizontal traction force, and wherein said damping unit, said chock and said wedge being dimensioned such that the upper surface of the end plate of the sleeve is level with the top of the housing during transport of the load so that it normally rests on the housing, and wherein said traction force functions to automatically and irreversibly insert said damping unit between said load and its bearing point on the floating support by transverse movement of said wedge as soon as the weight of the load is removed from said floating support at said bearing point.

* * * * *